US005152561A

United States Patent [19]

Engebretson

[11] Patent Number: 5,152,561

[45] Date of Patent: Oct. 6, 1992

[54] DOOR HANDLE AND LATCH ASSEMBLY FOR A SLIDING DOOR

[75] Inventor: David C. Engebretson, Tampa, Fla.

[73] Assignee: NJ Window Components Inc., Tampa, Fla.

[21] Appl. No.: 738,989

[22] Filed: Aug. 1, 1991

[51] Int. Cl.[5] ..... E05C 1/04

[52] U.S. Cl. ..... 292/145; 292/DIG. 46

[58] Field of Search ..... 292/145, 137, 147, 152, 292/DIG. 46, DIG. 47, 149, 183, 189

[56] References Cited

U.S. PATENT DOCUMENTS

| | | | |
|---|---|---|---|
| 184,184 | 11/1876 | Steele | 292/145 |
| 687,032 | 11/1901 | Karrenberg | 292/152 |
| 1,656,587 | 1/1928 | Huyck | 292/DIG. 46 X |
| 2,952,883 | 9/1960 | Kessler et al. | 20/52.2 |
| 3,050,322 | 8/1962 | Miller | 292/114 |
| 3,085,300 | 4/1963 | Carlston | 292/DIG. 46 X |
| 3,161,923 | 12/1964 | Crain | 20/52 |
| 3,173,716 | 3/1965 | Silvers | 292/DIG. 46 X |
| 3,213,652 | 10/1965 | Tucker | 292/145 X |
| 3,944,266 | 3/1976 | Weaver | 292/145 |
| 4,480,862 | 11/1984 | Fleming | 292/DIG. 46 X |

*Primary Examiner*—Richard E. Moore

[57] ABSTRACT

A door handle and latch assembly for a sliding door comprises a main body having a finger gripping recess on one side facing outwardly to permit opening and closing of a sliding door and a latch member having an L-shaped bracket overlying a vertical edge of a door. The main body of the latch is located in a recess formed in the main body on the side opposite the side of the finger gripping recess. The recess is bounded also by a surface on the sliding door to form a channel in which the latch member can move up or down to lock and unlock the sliding door.

6 Claims, 1 Drawing Sheet

DOOR HANDLE AND LATCH ASSEMBLY FOR A SLIDING DOOR

BACKGROUND OF THE INVENTION

1. Field of the Invention

This invention relates to a door handle and latch assembly for sliding door closures, such as, sliding screen doors or windows.

2. DESCRIPTION OF THE PRIOR ART

Generally, sliding screen doors are relatively light, inexpensive and simple structures sold in a highly competitive market. For this reason, the components of the screen door, the frame and latch mechanism must be made by an economical method with a minimum of shaping and cutting operations.

Prior art latch mechanisms have usually comprised spring operated mechanisms requiring cutting operations in the frame of the screen door and the assembly of a large number of parts.

SUMMARY OF THE INVENTION

The present invention is directed to a door handle and latch assembly for sliding doors which is a simple structure and which can be attached to a frame member of the door by an installer at the job site or at the time of manufacture of the door. The door handle and latch mechanism are simple to manufacture with a minimum of moving parts.

OBJECTS OF THE INVENTION

It is an object of the present invention to provide a cheap, easily manufactured door handle and latch assembly.

It is another object of the present invention to provide a door handle and latch assembly which can be attached to the inner surface of a door frame member without necessitating any cutting operations of the door frame.

It is a further object of the present invention to provide a screen door handle and latch assembly which can be easily attached to a frame member of the door by the door installer on the job.

BRIEF DESCRIPTION OF THE DRAWINGS

The foregoing and other objects, advantages and features of construction will become apparent to those skilled in the art from a consideration of the following detailed description of the invention taken in conjunction with the accompanying drawing in which like elements are represented by like numerals and in which.

DESCRIPTION OF THE PREFERRED EMBODIMENT

Figure 1:
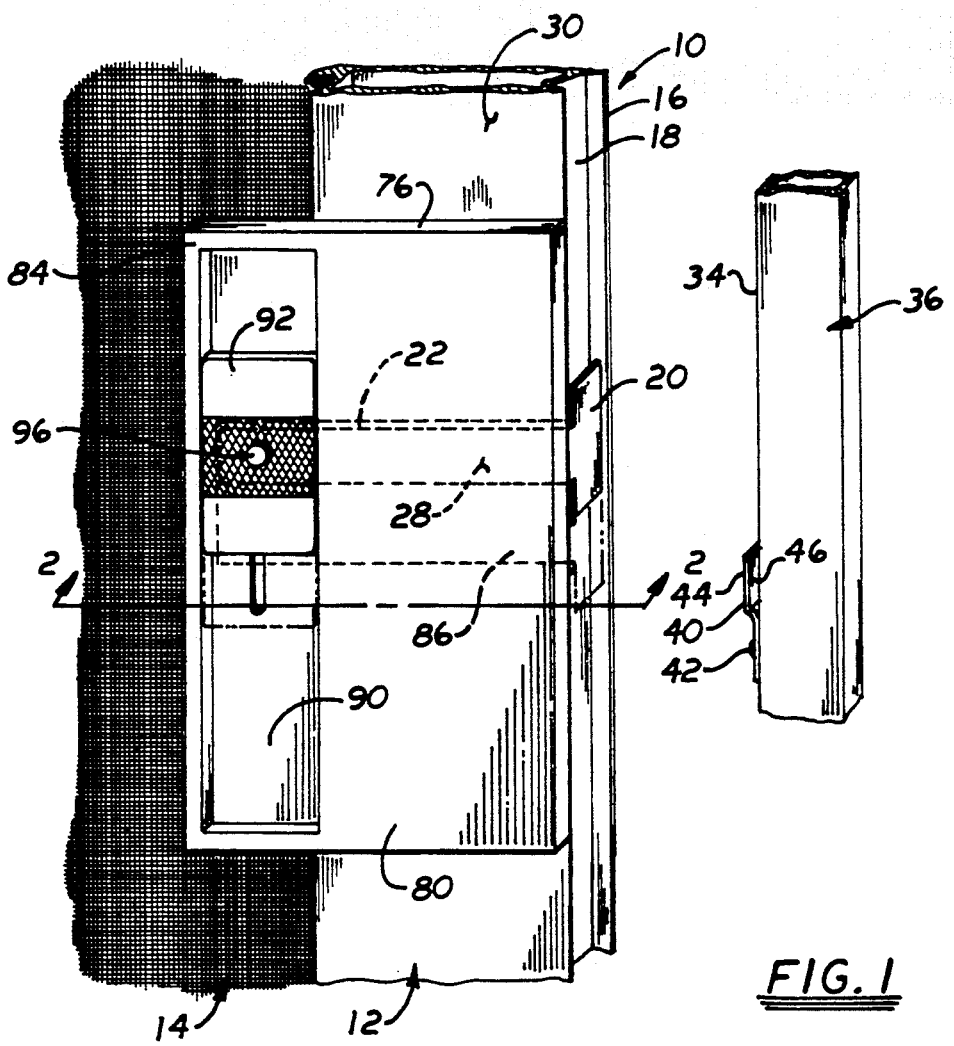
FIG. 1 is a side view of a portion of a sliding screen door with the door handle and latch assembly of the present invention attached thereto.

Referring to FIG. 1 of the drawing, there is shown one vertical end of a sliding screen door 10 comprising a vertical frame member 12 to which is attached a screen mesh 14. The combination of a frame member 12 and screen mesh 14 is well known to those skilled in the art. The screen door is a conventional door with four frame members enclosing a screen mesh, the bottom horizontal frame member (not shown) may have conventional rollers combined therewith to permit easy opening and closing of the screen door.

The vertical end wall 16 of frame 12 has a face 18 which is slightly recessed to receive a bracket portion 20 of a latch member 22 of a door handle and latch assembly. Latch member 22 (shown in greater detail in FIGS. 3 and 4) is a flat, thin piece of metal, usually thin steel plate, having a 90° bend to provide a short locking bracket member 20. The main flat portion 28 of latch member 22 which is at right angles to locking bracket member 20 extends parallel to and along the outer face 30 of frame 12.

Facing bracket member 20 of latch member 22 and attached to the vertical face 34 of a door jamb 36 is a fixed door latch keeper 40. Door latch keeper 40 is a thin, narrow, steel bracket slightly narrower than the recessed face 18 of frame 12 and secured to the face of door jamb 36 by a screw 42. Door latch keeper 40 is aligned with the recessed face 18 of frame 12 and is designed to be received within the recessed face 18 of frame 12 when the sliding screen door 10 is closed against face 34 of door jamb 36. Door latch keeper 40 has an offset flange 44 which extends slightly outwardly of face 34 of door jamb 36 and permits locking bracket member 20 of latch member 22 to engage flange 44 between the inner surface 46 of flange 44 and the face 34 of door jamb 36.

Figure 2:
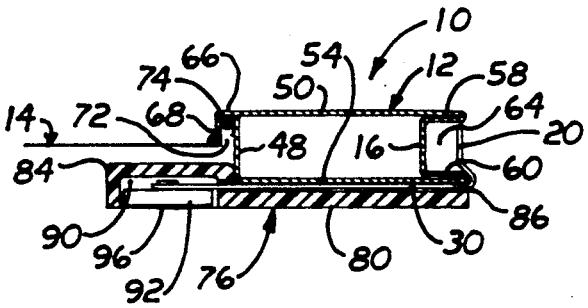
FIG. 2 is a cross-sectional view of the sliding screen door and door handle and latch assembly taken along lines 2—2 of FIG. 1 .

Referring now to FIG. 2, there is shown a cross-sectional view of screen door 10 taken along lines 2—2 of FIG. 1. Sliding screen door 10 comprises frame member 12 of thin aluminum or sheet steel having a rectangular form bounded by walls 48, 50, 16 and 54. Wall 50 of frame 12 extends outwardly of wall 16 to form a flange 58 and wall 54 extends outwardly of wall 16 to form flange 60. Wall 16, and extensions 58 and 60 form a recessed area 64 in which bracket member 20 of latch member 22 can move up or down to unlock or lock sliding screen door 10 by receiving door latch keeper 40 in said recessed area behind bracket member 20 of latch member 22.

A short L-shaped flange 66 extends upwardly along the upper edge of wall 50 of frame member 12. L-shaped flange 66 has a wall 68 extending over and spaced from wall 48 of frame member 12 to form a channel 72 in which screen mesh 14 is held by a rubber retainer 74.

Secured to the inner surface of wall 54 of framing member 12 is a door handle and latch assembly 76. Door handle and latch assembly 76 comprises a main body 80 having an offset extension 84 and latch member 22. Main body 80 may be secured to face 30 of frame member 12 by adhesive, a double faced adhesive strip, or by rivets or other fasteners as desired. Main body 80 and offset extension 84 may be made of hard plastic material such as polypropylene. Main body 80 has a width which extends from the outer edge of flange 60 of wall 54 to a point slightly beyond the upper edge of wall 54. Extension 84 is offset slightly to form a 90° angle with respect to wall 48 of frame member 12. The junction of main body 80 and extension 84 form a corner which rests on wall 48 of framing member 12.

Extension 84 has a channel 86 lying between the outer face 30 of frame 12 and a portion of main body 80 in which bracket member 20 is free to reciprocate forward or back (as shown) to lock and unlock screen door 10 in connection with door latch keeper 40. Extension 84 also has a recessed finger gripping area 90 (see FIG. 1) in which a knob 92 (shown as a knurled square in FIG. 1) can move.

Knob 92 is connected to latch member 22 by a screw or rivet 96. Knob 92 is the means by which latch member 22 and its bracket member 20 are moved up and down to lock or unlock the sliding screen door 10.

Figure 3:
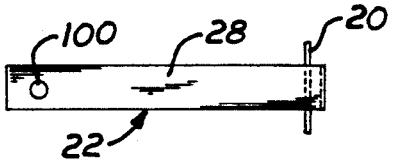
FIG. 3 is a top elevational view of the latch of the present invention.
Figure 4:
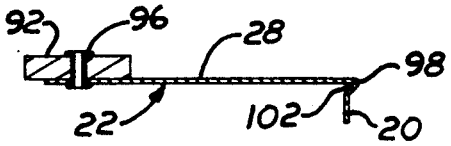
FIG. 4 is a sectional side view of the latch of the present invention.

Referring now to FIG. 3 there is shown latch member 22 in an elevational view looking down on latch member 22. Latch member 22 is a thin sheet of steel, about 22 gauge, and is in the form of a longitudinal, narrow main flat portion 28 having a pre-cut hole 100 to receive a screw or rivet 96. Near the left hand end of main flat portion 28 is an integral bracket member 20 which is at a 90° angle with respect to portion 28. Bracket member 20 is made wider than the narrower main flat portion 28.

At the juncture of blade 28 and bracket member 20 there is a small section of blade 98 which is bent to have a narrow channel 102 and to offset latch member 22 slightly short of the end of blade 98. Channel 102 is designed to fit over flange 60 of wall 52 and permit locking bracket member 20 to be spaced a short distance from wall 52 of frame member 12. It is in this space 64 that door latch keeper 40 will be held when the sliding screen door 10 is locked against door jamb 36.

Recessed area 90 of extension 84 of main body 80 is designed to form a finger gripping recess of the door handle and latch assembly.

In addition, a finger-gripping door handle (not shown) is secured by adhesive or other means to the opposite side of frame 12 on the inside of sliding screen door 10. This latter door handle does not need the latch assembly of latch member 22 but comprises conventional and ordinary hardware well known in the sliding screen door art.

Thus, sliding screen door 10 can be opened and closed by moving the door along a track (not shown}by using a finger gripping recess in the door handle. Sliding screen door 10 can be locked by engaging bracket member 20 of latch member 20 with door latch keeper 40 secured to door jamb 36.

Whereas, the present invention has been described with respect to specific embodiments thereof, it should be understood that the invention is not limited thereto, and as many modifications thereof may be made. It is therefore contemplated to cover by the present application any and all such modifications as fall within the true scope and spirit of the appended claims.

I claim:

1. A door handle and latch assembly for a sliding door having flat, uninterrupted vertical side walls on frame members of said sliding door wherein said sliding door can be locked to a door latch keeper attached to a door jamb comprising a main body having a finger grip depression area on one side of said main body, said main body being secured to the outside surface of one of said flat vertical side walls of said sliding door, a latch member, said latch member being located entirely outside of one of said flat vertical side walls of said sliding door, means for securing said main body against the outside wall of a door frame member, said main body having a slot on the side of said body opposite the side having said finger grip depression, said latch member being inserted into said slot, and means for reciprocating said latch member in said slot, whereby said latch member can be moved into and out of locking engagement with a door latch keeper.

2. A door handle and latch assembly for a sliding door as recited in claim 1 in which said latch member is L-shaped, having a main flat portion and a bracket member extending at 90° with respect to said main portion, said bracket member lying across an edge of said sliding door.

3. A door handle and latch assembly for a sliding door as recited in claim 2 in which said latch member has a channel at the junction of said main flat portion and said bracket member and said bracket member is offset slightly away from one end of said main flat portion.

4. A door handle and latch assembly as recited in claim 2 in which said means for reciprocating said latch member is a knurled knob fixed to said main flat portion of said latch member.

5. A door handle and latch assembly for a sliding door as recited in claim 2 in which said bracket member is wider than said main flat portion of said latch member.

6. In combination a sliding screen door having a recessed vertical edge and a door handle and latch assembly as recited in claim 2.

* * * * *